US006932234B2

(12) United States Patent
D'Amato

(10) Patent No.: US 6,932,234 B2
(45) Date of Patent: Aug. 23, 2005

(54) CUP-SHAPED RECEPTACLE AND LID

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 78 days.

(21) Appl. No.: 10/441,085

(22) Filed: May 20, 2003

(65) Prior Publication Data

US 2004/0011803 A1 Jan. 22, 2004

(30) Foreign Application Priority Data

May 29, 2002 (DE) ..... 202 08 386 U
Dec. 19, 2002 (EP) ..... 02028705

(51) Int. Cl.[7] ..... B65D 43/03
(52) U.S. Cl. ..... 220/781; 206/503
(58) Field of Search ..... 220/780–784, 220/790, 792, 711, 713, 703, 708, 709, 793, 794, 309; 206/503–509

(56) References Cited

U.S. PATENT DOCUMENTS

| | | | | |
|---|---|---|---|---|
| 3,065,875 A | | 11/1962 | Negoro | |
| 3,583,596 A | | 6/1971 | Brewer | |
| 3,749,277 A | | 7/1973 | Kinney | |
| 5,253,781 A | * | 10/1993 | Van Melle et al. | 220/713 |
| 5,944,208 A | * | 8/1999 | Gale | 215/296 |
| 5,975,344 A | | 11/1999 | Stevens | |
| 6,056,144 A | * | 5/2000 | Strange et al. | 220/297 |
| 6,612,456 B1 | * | 9/2003 | Hundley et al. | 220/254.3 |
| 6,688,487 B2 | * | 2/2004 | Oakes et al. | 220/788 |

FOREIGN PATENT DOCUMENTS

| | | |
|---|---|---|
| DE | 299 06 577 | 7/1999 |
| FR | 1 379 233 | 11/1964 |
| FR | 1 526 655 | 5/1968 |
| WO | 02 30783 | 4/2002 |

* cited by examiner

*Primary Examiner*—Lien M. Ngo
(74) *Attorney, Agent, or Firm*—Young & Thompson

(57) ABSTRACT

A cup-shaped receptacle has an outer bead in its opening area for clipping on a plastic lid, which has a circumferentially continuous clamping groove for receiving the bead. The clamping groove is continued outwards by an elastically deformable constriction, and inwards by an outer wall of a circumferentially continuous, U-shaped lid recess, whose U-web of is situated below the height position of the constriction and whose inner leg wall forms a part of a dome wall of a dome which extends upwardly beyond the height position. The lid recess extends downwards beyond the height position and has an outer diameter at its outer surface which is adapted to the inner diameter of the receptacle wall such that the lid recess functions at least as a centring and guide projection for the lid-clip-on action, which projection slidingly co-operates with the receptacle wall already at least while the bead passes the constriction.

14 Claims, 12 Drawing Sheets

CUP-SHAPED RECEPTACLE AND LID

FIELD OF THE INVENTION

The present invention relates to a cup-shaped receptacle and to a lid for such a receptacle.

BACKGROUND OF THE INVENTION

Of the clip-on plastic lid on the cup-shaped receptacle in U.S. Pat. No. 5,253,781 A, the outer surface of the outer leg wall of the lid recess extends downwards just slightly beyond the height position of the constriction. The cone angle and the outer diameter of the outer surface are matched with the cone angle and the inner diameter of the receptacle wall such that outer surface does not get in significant contact with the receptacle wall even when the bead of the receptacle, which is implemented as a curled rim, fully is seated on the clamping groove. Due to the comparatively short outer surface and the large radial dimension of the U-web of the lid recess, the clamping groove tilts inwards during the clip-on movement; this hinders the bead to smoothly move over the whole circumferential length past the constriction. It is necessary to first manually centre the lid with the clamping groove neatly on the bead and then to clip on the lid by pressure directly acting on the upper wall of the clamping groove with a sliding rotating movement of the hand. This clip on action is troublesome, time-consuming and increases the risk that the bead does not properly snap into the clamping groove at some locations along the circumference of the cup opening. This has the effect that liquid may leak through when the full cup is tilted. The lid easily pops off inadvertently if the full receptacle falls over, because the cup opening region easily gets deformed radially.

SUMMARY OF THE INVENTION

It is an object of the present invention to provide a receptacle as well as a lid which is suitable for said receptacle, by means of which an easy clip-on action of the lid can be achieved, even by unskilled persons, such that the clipped on lid provides leakage-proofness and hardly pops off when the full cup falls over. Even though the invention intends to achieve a high lid holding force and perfect tightness, the lid ought to be clipped on easily.

Since, according to the invention, the outer leg wall has a relatively long downward extension, the U-web of the lid recess, and the inner leg wall commonly constitute a rigid centring and guide projection which slidingly contacts the receptacle wall at least already while the bead moves past the constriction. The clamping groove automatically is precisely centred on the bead, and the bead is clipped-on virtually at one go and along its whole circumferential length, past the constriction into the clamping groove by applying pressure essentially only on the dome top wall. The sliding contact between the outer surface and the receptacle wall guides the constriction uniformly over the bead, since thanks to guidance and centring, the bead generates uniform resistance against the lid downward movement everywhere. The guiding projection converts the pressure applied to the dome into a downwardly oriented pulling force uniformly distributed along the constriction to pull the constriction uniformly past the bead, until the bead is correctly positioned in the clamping groove. This advantageous effect of the centring and guide projection, which actually is a cone or a cylinder, and the uniform force transmission, in co-action allow to provide a strong force fit between the bead and the clamping groove, said force fit resulting from a relatively narrow dimensioning between the bead and the clamping groove and the given elasticity. This assures that the clipped on lid prevents leakage, and that the bead does not even locally leave the clamping groove if the full cup falls over. The shape of the dome and of the lid recess result in a rigid structure integrated into the lid, by which structure the applied clip-on force effectively clips on the lid without significant buckling of the lid. The clipped on lid markedly stiffens the opening area of the receptacle resulting in excellent spill-proofness and good leakage-proofness as well.

A particularly important aspect of the invention is a circumferentially continuously operating hinge mechanism integrated into the lid. This allows to easily clip-on the lid, in practice by a quick grasp of the hand. As soon as pressure is applied at least on the dome top wall, the dome is lowered, the dislocated inner leg wall tilts the U-web downwardly about the hinge formed at the transition between the U-web and the outer leg wall as soon as the resistance to movement of the constriction over the bead starts to increase. The tilting movement of the U-web temporarily tends to pull the outer leg wall away from the inner wall of the receptacle. The contact between the bead and the constriction tilts the constriction outwards and the clamping groove diverges somewhat. Due to the clip-on pressure or, if necessary, by automatically also or alternatively pressing on the outer lid periphery when the dome is pushed downwardly, the bead passes the constriction easily and in one go. When the pressure ceases, the hinge mechanism re-establishes the fit of the lid, i.e., the U-web returns into a position essentially perpendicular to the axis of the lid and firmly holds the outer leg wall against the inner wall of the receptacle. The constriction is returned behind the bead until the bead is in a tight and hermetically sealed force fit in the clamping groove. The upwardly protruding dome allows to actuate the joint mechanisms by first lowering the dome relative to the clamping groove and to open the clamping groove before the bead slips through. Then the dome returns into its initial elevated position. During clip-on the dome top wall may be lowered by the applied pressure until the palm of the hand assists at the lid periphery to easily complete the clip-on action.

The bead of the receptacle can be formed as a curled bead or a full rolled rim, or a partially curled bead or half rolled rim, or instead as an outwardly bent edge flange. An easy and comfortable clip-on action of the lid is achieved in any case, resulting in the final leakage-proofness and the stable lid holding effect. One lid design fits many bead designs.

The lid is designed in view to an optimised and easy clip-on action, despite a powerful force fit in the clipped on condition. Thanks to its shape the lid is relatively stiff in its central region such that the bead easily and completely can be clipped-in the clamping groove into a tight form fit and force fit just by pressing in clip-on direction, assisted by the guidance of the guide projection, and by temporarily opening the clamping groove by a movement of the dome relative to the constriction.

For this function it may be important that the U-web extends substantially planar and substantially perpendicularly to the lid axis, and that the inner leg wall is substantially parallel to the lid axis. Due to those structural features the integral hinge mechanism is acting well when downward pressure is applied on the lid, mainly since for mechanical reasons the inner leg wall behaves more rigid than the outer leg wall when the U-web is tilted such that consequently the outer leg wall has to yield inwards and then temporarily opens the clamping groove from the inner side.

It may be expedient when the outer surface slidingly co-operates with the receptacle wall already before the bead starts to deform the constriction elastically. This has the effect that the clamping groove and the constriction, respectively, are put over the bead at a neatly centred position so that the bead will have to overcome essentially the same resistance to passage over its whole circumferential length and therefore easily and uniformly is clipped into the clamping groove.

When the cone angles of the outer surface and of the receptacle wall are approximately identical, the outer diameter of the outer surface should correspond, at the height position of the constriction, at least approximately to the inner diameter of the receptacle wall in the opening area so that the centring and guide effect already starts before the bead reaches the constriction. When the bead snaps into the clamping groove, especially the softer material of the receptacle will yield in the bead and in the receptacle wall so that a strong positive engagement will be established, when the lid is clipped-on. Additively or alternatively, also the outer leg wall of the lid recess may slightly yield inwards, as a consequence of the contact pressure between the outer surface and the receptacle wall.

The outer diameter of the outer surface in the clamping groove even may be markedly larger than the inner diameter of the receptacle wall in the opening area, i.e. where the inner wall curves outwardly into the bead. This measure guarantees that during the whole movement of the bead past the constriction into the clamping groove a significant guidance and centring will take place.

A markedly downward extension of the outer surface beyond the height position of the constriction is important for the intended centring and guiding effect. The lid may be clipped-on by mere application of pressure substantially only on the dome. The outer surface may have at least 2.5 times the height of the clamping groove. Providing 3 times the height, or even 4 times the height of the clamping groove may be still better. It is to be noted that, due to the pressure between the outer surface and the receptacle wall and by a large contact area an extremely effective sealing effect will result complementary to the sealing effect of the bead in the clamping groove.

A cone angle between approx. 6° and 12°, i.e. an overall cone angle between approx. 12° and 24°, may be expedient. A preferred angle range amounts to between approx. 8° and 10°, i.e. between approx. 16° and 20° in total.

Depressions formed where the top of the dome top wall merges with the outer dome wall facilitate the easy clip-on action of the lid and increase the rigidity of the dome. Furthermore, the depressions provide visual clues where to apply the fingers and define gripping spots for comfortably removing the lid from a lid-stack. Undercut depressions do not only provide a hand grip, but even may define lid stacking shoulders. Each lid may only rest with the shoulders of the depressions on the dome top wall of the next lid such that the lids in the stack can not get jammed.

In order to achieve the strong force fit between the bead and the clamping groove, which is important for the sealing effect, the radial thickness of the bead should be larger than the radial interior width of the clamping groove. The soft paper or paperboard material of the receptacle and the material of the bead, respectively, yield on the inner side and on the outer side as soon as the bead is seated in the clamping groove. Squashed zones with planar contact areas, i.e. not only line contacts, result in an improved sealing effect.

The radial thickness of the bead should be between 10% and 20%, preferably approx. 15%, larger than the average radial interior width of the clamping groove. This dimensioning results in a good sealing effect and, simultaneously, only moderate forces will be necessary for clipping the lid onto the receptacle.

In order to enhance the holding effect of the lid on the bead and to gradually squash the material, the radial interior width of the clamping groove may decrease in a direction opposite to the clip-on direction; expediently with the cone angle of the receptacle wall. The clamping groove will, in this way, produce a wedge effect until the bead finally settles in position.

In order to improve the holding effect for the clip-on lid at least one belt-like zone with an increased coefficient of friction ought to be provided at the outer surface of the outer leg wall and/or at the inner wall of the receptacle. This might result in an increased friction engagement between the lid and the receptacle and a stiff cup opening region.

A further important aspect of the invention is that the constriction may consist of successive deeper and shallower depressions formed from the exterior. Preferably, the deeper depressions are longer in circumferential direction than the shallower depressions. This facilitates the clip-on action but results in a stable and durable holding effect, and stiffens the lid periphery.

A plurality of upwardly protruding beverage distinguishing protrusions in the dome top wall may be provided to allow identification of the type of liquid from outside, e.g. coke, diet coke, orange juice, etc. The protrusions may be push-in buttons.

A further generally important aspect is a penetration region formed in the dome top wall. This region may have a thinner wall thickness than at least the dome top wall, and has intersecting score lines through which a straw comfortably may be introduced by breaking the score lines. The reduced wall thickness allows to insert the straw more easily. The reduced wall thickness may be produced by locally compressing the material of the lid. The region with reduced wall thickness is particularly useful for a relatively stiff lid having a somewhat thicker wall than such conventional lids. Providing the thinner region, however, is of general advantage for all such lids, because this measure generally facilitates the introduction of a straw.

The penetration region for introducing a straw expediently is provided at the bottom of a recess e.g. located in the centre of the dome top wall. The reduced bottom wall thickness increases the rigidity of the dome in view to the easy clip-on action.

The penetration region may be curved inwardly to facilitate the introduction of a straw and to increase the resistance against buckling outwards by liquid pressure. The curvature also leads to an automatic closing effect of the broken score lines after the straw is withdrawn and when liquid pressure acts from inside on the flaps defined by the broken score lines. A contour of the recess corresponding to two ellipses the main axes of which are offset to each other by 90° increases the rigidity of the dome and offers an attractive appearance of the dome design. The score lines expediently are formed along the main axes of both ellipses. It might suffice to have only a thin walled core portion of the bottom instead to facilitate the introduction of a straw.

A further important aspect of the invention is directed to an easy clip-on lid for a conical double wall paper or cardboard receptacle. Double wall paper or cardboard receptacles, conventionally, have an opening area where the inner receptacle wall is deformed outwardly at a step and is connected with the outer receptacle wall. The bead is formed on the upper end of the inner receptacle wall. The cone angle of the conical inner wall of the double wall receptacle is bigger below the widened upper opening area which forms a continuation of the lower receptacle wall by a circumferential shoulder and has a smaller or even zero cone angle than the lower receptacle wall. The lid placed on the bead already contacts the widened opening area inner wall by the centring and guide cone when the bead reaches contact with the constriction. During the clip-on action the lid is centred and guided over the bead. The centring and guide projection is pulled inwardly due to the deformation taking place between the pressed down dome and the clamping groove such that the bead more easily passes the constriction. The lid, when clipped-on, provides high leakageproofness and stiffness in the receptacle opening region.

Expediently, the cone angle of the outer surface or the centring and guide projection either may be zero or has a value which is smaller than the angle value of the cone angle of the receptacle inner wall. The rigid centring and guide projection forces the bead into a leakageproof seated condition in the clamping groove and even may cause a deformation of the opening area of the double wall receptacle for intensified receptacle rim portion stiffening and sealing purposes.

The centring and guide projection, in this case, ought to be continued downwardly by an inward stepped portion of the outer leg wall dimensioned for a press-fit co-action with the receptacle wall. The inwardly stepped portion should have a cone angle essentially equal to the cone angle of the inner receptacle wall below the upper stepped opening area. The co-action between the stepped portion and the receptacle inner wall provides an intensified sealing effect even deep inside the receptacle.

BRIEF DESCRIPTION OF THE DRAWINGS

Embodiments of the invention are explained making reference to the drawings, in which:

FIG. 2 is intended to be used.

DESCRIPTION OF THE PREFERRED EMBODIMENTS

Figure 1:
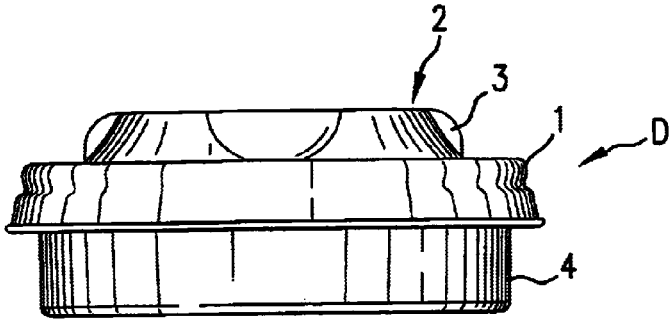
FIG. 1 is a wide side view of a lid.
Figure 2:
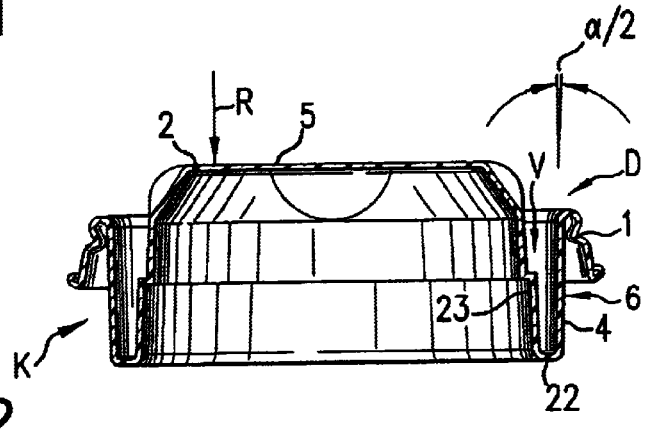
FIG. 2 is a section along the axis of the lid of FIG. 1.

A lid D, which is intended to be used for a cup-shaped receptacle C consisting of paper or paperboard or plastic material is e.g. drawn from elastic plastic foil material and has a wall thickness of e.g. 0.3 to 0.5 mm (FIG. 1). The lid is adapted to be clipped on an opening area 9 of the receptacle C such that said receptacle C is closed in a leakage-free manner and such that the lid D will not come off, not even if the full receptacle C falls over. The lid D (FIG. 1) is provided with a peripheral, circumferentially continuous clamping groove 1, above the plane of which a dome 2 vaults on the inner side of the clamping groove 1. The dome 2 is separated from the clamping groove 1 by a circumferential substantially uniform lid recess V and is provided with an essentially planar dome top wall 5 and several circumferentially distributed depressions 3. Relative to the clamping groove 1, an outer leg wall 4 of a lid recess V (FIG. 2) extends markedly downwards beyond the plane of the clamping groove 1.

The lid D (FIG. 2) is clipped onto the opening area 9 of the receptacle C (FIG. 3) by applying pressure R e.g. only on the dome top wall 5 in clip-on direction. The dome top wall 5 extends essentially parallel to the plane of the lid D. The lid recess V has a U-shaped cross-section and concentrically surrounds the dome 2. The lid recess V is bound by the outer leg wall 4, which in this embodiment tapers conically downwards, a lower U-web 22, and an inner leg wall 23 which forms an upwardly extending outer dome wall. The outer leg wall 4 has an outer surface 6 which extends into the clamping groove 1. The outer surface 6 is arranged at a conical angle $\alpha/2$, which may correspond at least essentially to the conical angle $\alpha/2$ of a receptacle wall 7 of the receptacle C.

Figure 3:
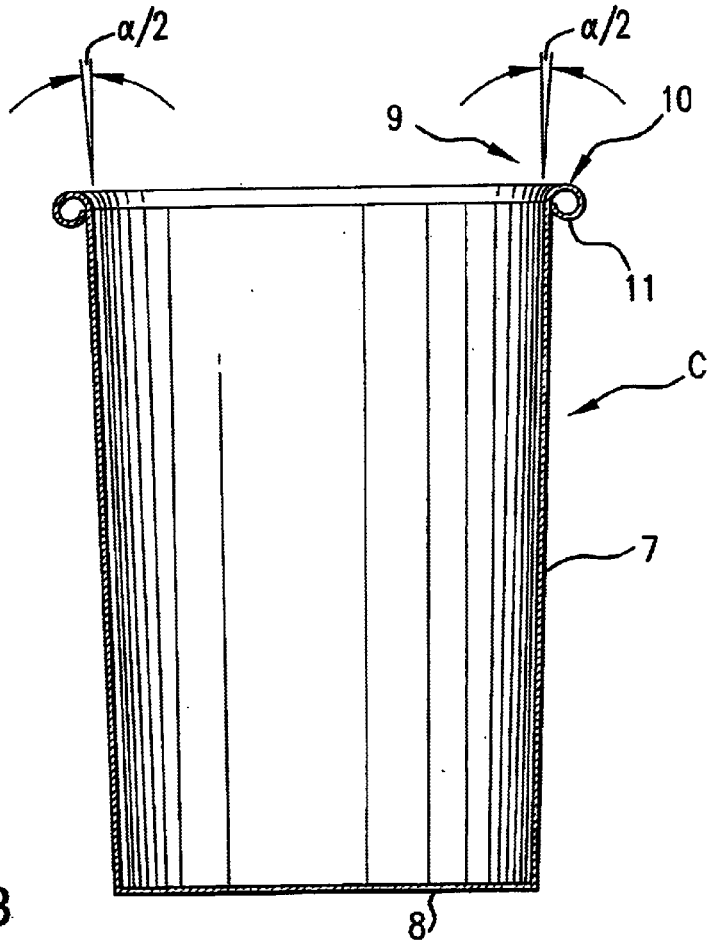
FIG. 3 is a section along the axis of a receptacle for which the lid of FIG. 1.

At the lower end of the receptacle wall 7 in FIG. 3, a receptacle bottom 8 is arranged, whereas the opening area 9 of the receptacle is delimited by the receptacle wall 7 and an outwardly projecting bead 10, preferably a so-called curled rim 11 consisting of the paperboard or paper material of the receptacle C. In the case of a plastic receptacle, the bead 10 may also be produced by injection moulding. The bead instead may be only a half curled bead or an outwardly projecting receptacle rim flange.

Figure 4:
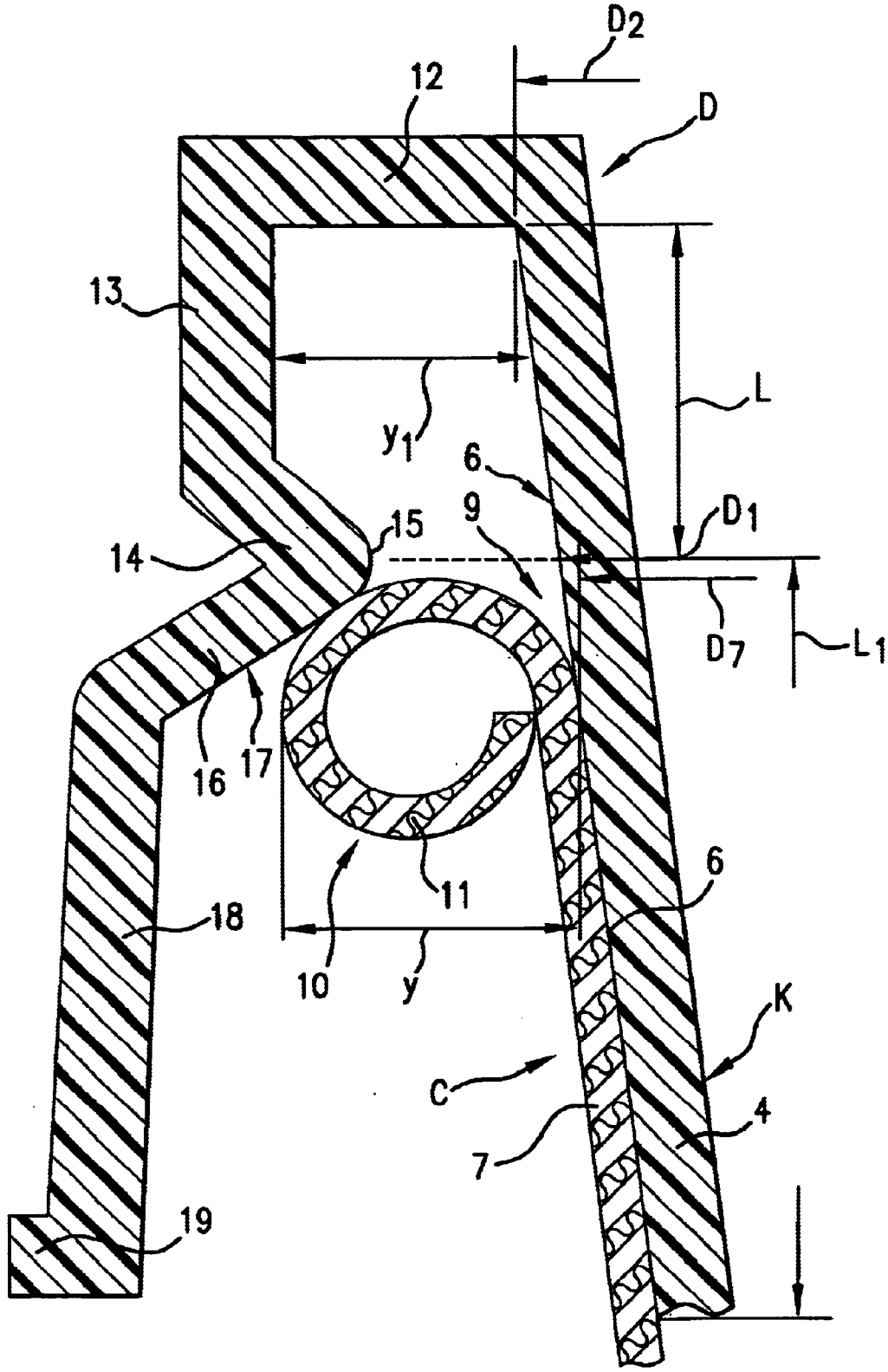
FIG. 4 shows an enlarge sectional view of a phase during the clip-on operation of the lid to be used.

FIG. 4 shows the lid D on the bead 10, which is formed as a curled rim 11. A constriction 14 of the lid D rests on the bead 10.

The outer leg wall 4 is continued, at the upper end by a wall 12 which extends approximately parallel to the plane of the lid and by a circumferential apron 13. The apron 13 extends approximately parallel to the axis of the lid D down to the constriction 14. The constriction 14 may be a scorelike depression from the outside and forms an interior rounded crest 15. The crest 15 and the constriction 14 can be continuous in circumferential direction, or alternatively can be formed by individual local depressions between which (indicated by broken lines) the outer contour approximately continues. The constriction 14 is continued downwardly by an outwardly inclined wall 16 defining a clip-on ramp 17. From wall 16, a further apron 18 extends downwards, terminating at an exterior flange 19. The height of the further apron 18 could be shorter than shown.

The radial thickness Y of the bead 10, measured at the transition from the straight receptacle wall 7 to the curvature of the bead 10, may be larger than the radial interior width Y1 of the clamping groove 1. The radial thickness Y may exceed the interior width Y1 by 10% to 20%, preferably by approx. 15%. In the clamping groove 1 the radial interior width Y1 gradually decreases, preferably with the cone angle $\alpha/2$ from the constriction 14 towards the wall 12.

The clamping groove 1 defines a length L between the crest 15 and the inner side of the wall 12. The outer leg wall 4 extends downwards beyond the height position of the constriction 14 by a length L1 which may be equal to at least 2.5 times the height L, preferably 3 times, and even more preferably 4 times the height L or more.

The outer diameter D1 of the outer surface 6 of the outer leg wall 4 at the height position of the constriction 14 (e.g. the crest 15) at least largely corresponds to the interior diameter D7 of the receptacle wall 7 at the bead 10, i.e. at the transition from the straight receptacle wall 7 to the outwardly directed curvature of the bead 10. The outer diameter D2 of the outer surface 6 of the outer leg wall 4 at the junction with wall 12 is even markedly larger than the interior diameter D7.

Figure 5:
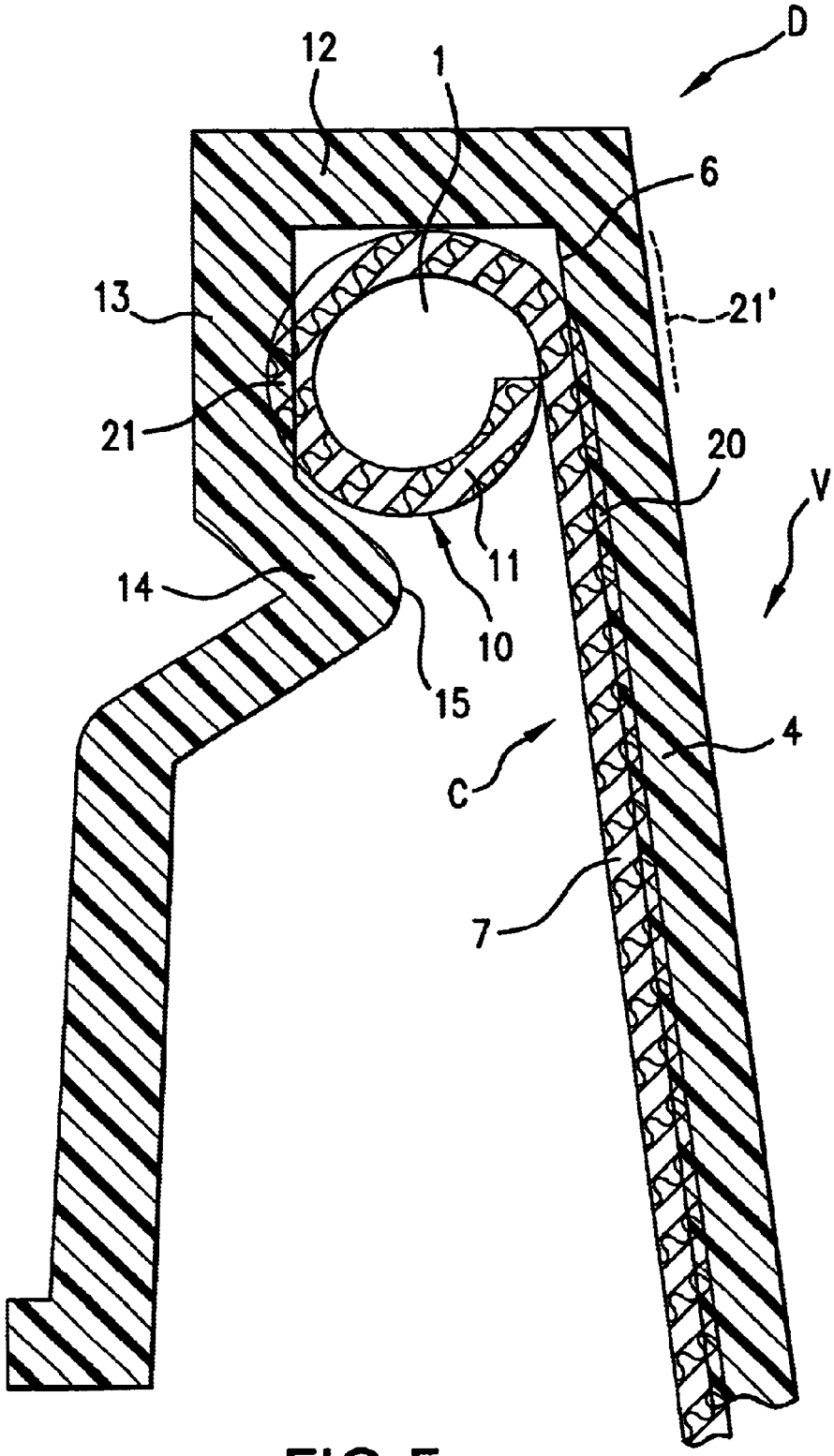
FIG. 5 shows a sectional view of a phase in which the lid has fully been clipped onto the receptacle.

When pressure R is applied on the dome 2 in FIG. 4 the outer surface 6 already slidingly contacts the receptacle wall 7 before or as soon as the bead 10 reaches the constriction 14. The lid recess V forms a centring and guide projection K which supports and facilitates the easy clip-on operation of the lid D. It will be expedient when the sliding contact is established even before the bead 10 reaches the constriction 14. When the lid D is pressed down still further, the bead 10 will deform the constriction 14 elastically outwards; in the course of this process, also the bead 10 is slightly deformed before it moves over the crest 15 and snaps into the clamping groove 1 (FIG. 5). The criss-cross hatched regions shown in FIG. 5 indicate squeezed areas 20, 21 formed in the bead 10 and the receptacle wall 7, to promote the sealing, the holding and the stiffening effects. Alternatively or additively, also the outer leg wall 4 may slightly yield inwards (indicated in broken lines at 21').

Figure 6:
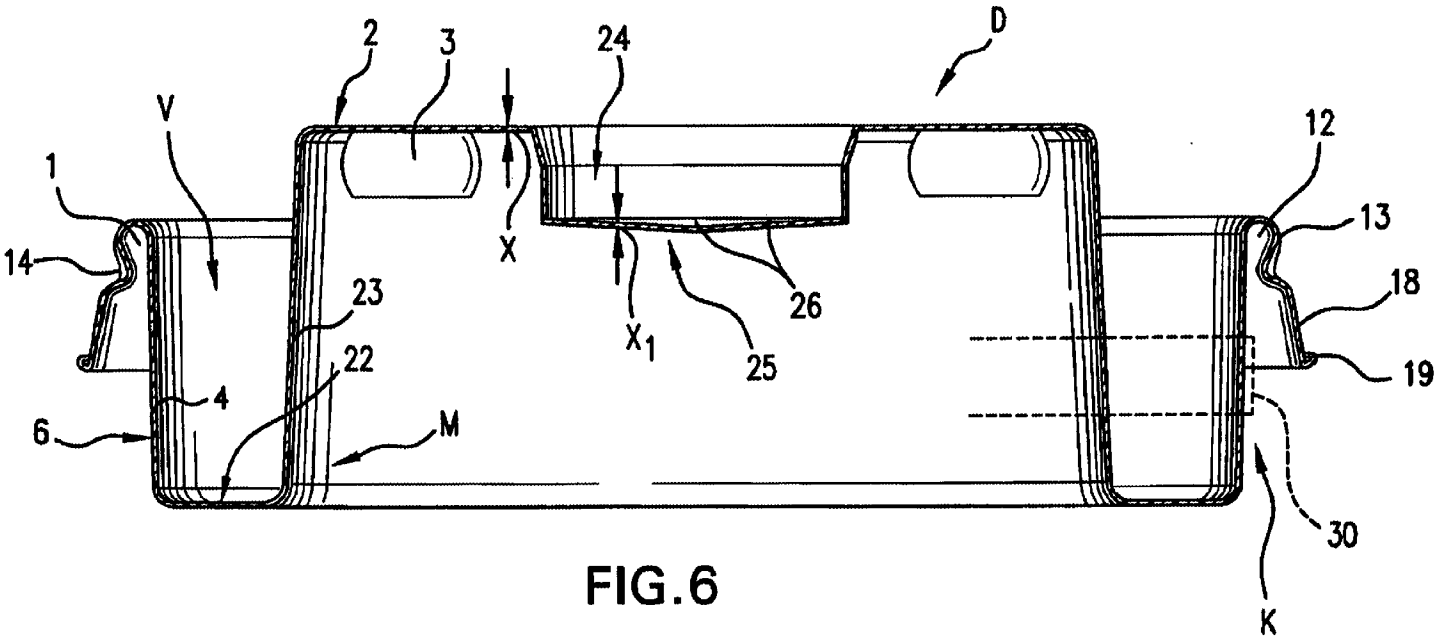
FIG. 6 is an axial sectional view of a further embodiment of a lid.
Figure 7:
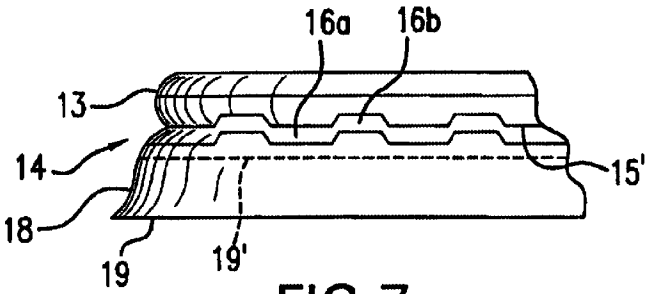
FIG. 7 is a view of a part of the lid of FIG. 6.

The lid D in FIGS. 6 to 10 differs from the lid D of FIGS. 1 to 5 by a modified design of the constriction 14 and by a recess 24 in the dome top wall 5. The constriction 14 (FIG. 7) is formed by alternating successive deeper and shallower depressions 16*a*, 16*b*. The depressions 16*a*, 16*b* form a snake line shaped inner crest 15'. The deeper depressions 16*a* may be longer in circumferential direction than the shallower depressions 16*b*. Furthermore, FIG. 7 shows by dotted line 19' a shortened apron 18.

In FIG. 6 the recess 24 has a bottom dome region 25 of limited size substantially parallel to and situated below the dome top wall 5. The wall thickness x of the lid D is substantially constant. Only the region 25 is thinner (thickness x1), e.g. by compressing the material. The region 25 is situated in the centre of the dome top wall 5. For introducing a straw the region 25 is formed with crossing breakable score lines 26. Expediently, the region 25 may be curved towards the inner side of the dome 2.

The depressions 3 in the transition from the dome top wall 5 to the inner leg wall 23 increase the rigidity of the dome 2 and allow to grip the lid D by the finger tips, e.g. in order to more easily remove the lid D from a stack of lids, and to put the lid D on the receptacle C. The clip-on force R even may be applied via the depressions 3 on the dome. However, preferably the easy clip-on action may be carried out by pressing the palm of the hand on the even dome top wall 5.

In FIG. 6 the outer leg wall 4 may have at least one beltlike circumferential zone 30 in which the coefficient of friction is increased in order to achieve an intensified holding effect as soon as the lid D is clipped-on. The zone 30 may be situated higher than shown, or may be narrower or wider. A respective zone with an increased coefficient of friction also could be provided at the receptacle wall 7, either instead of zone 30 at the lid, or in co-action with the zone 30 provided at the lid D.

A circumferentially continuous hinge mechanism M is integrated into the lid D by the design and the shape of the dome 2 and the lid recess V. The hinge mechanism may assist in clipping-on the lid D, as particularly shown in FIGS. 6 to 10.

The hinge mechanism M of the lid D consists of the dome 2, the inner leg wall 23, the U-web 22, and the outer leg wall 4. The transitions of the outer leg wall 4 into U-web 22 and of U-web 22 into inner leg wall 23 define hinges 29. The inner leg wall 23 extends essentially parallel to the longitudinal axis of the lid, while the U-web 22 is planar and perpendicular to the lid axis. It is to be noted that due to the rigidity of the dome 2 and due to the smaller diameter of the inner leg wall 23 in relation to the bigger diameter of the outer leg wall 4, the outer leg wall will yield inwardly easier than the inner leg wall 23. This effect is used to temporarily open the clamping groove 1 and to achieve an easy lid clip-on action.

Figure 9:
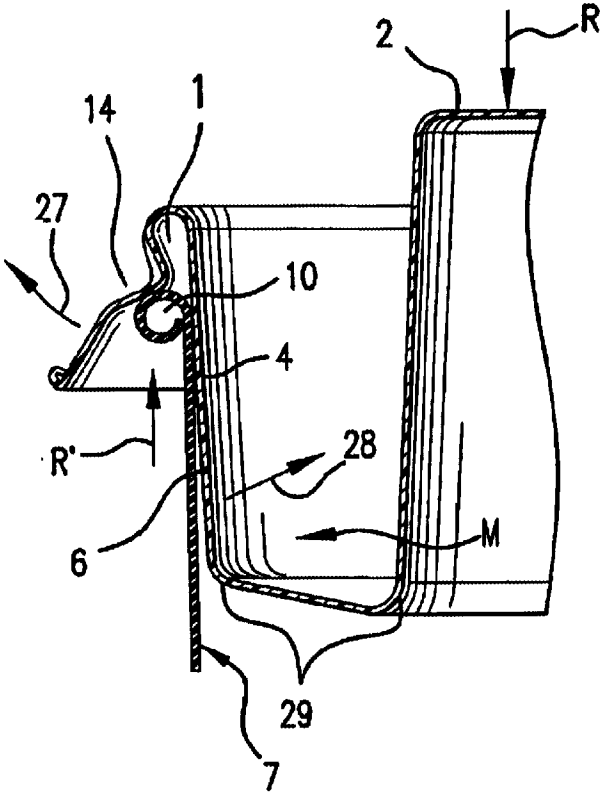
FIG. 9 is a view corresponding to FIG. 8, in a phase of the clip-on, in which the clamping groove temporarily is opened somewhat during clipping of the lid.
Figure 8:
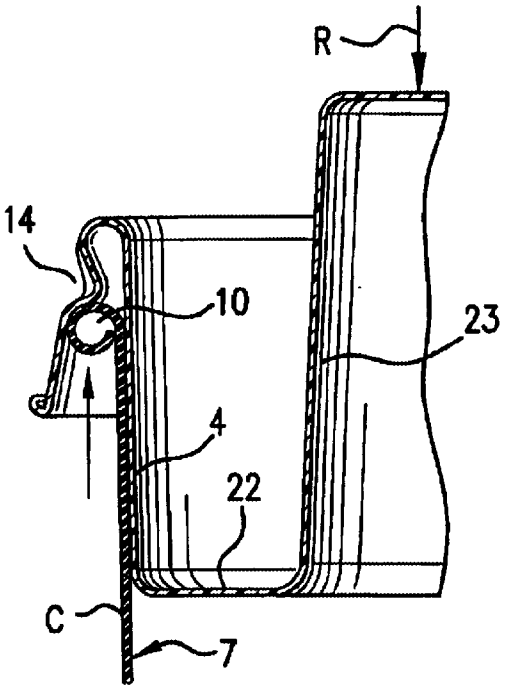
FIG. 8 is part of a portion of the lid of FIG. 6, in a phase of the clip-on action of the lid in which the bead of the receptacle just has reached the constriction.

FIG. 8 the lid D is put on the bead 10 of the receptacle C such that the entire circumferential extension of the constriction 14 is centered on the bead 10. The outer leg wall 4 contacts the receptacle wall 7. Now a clip-on force R is applied e.g. to the dome top wall 5, e.g. by the flat hand until the dome top wall 5 lowers (FIG. 9).

Figure 10:
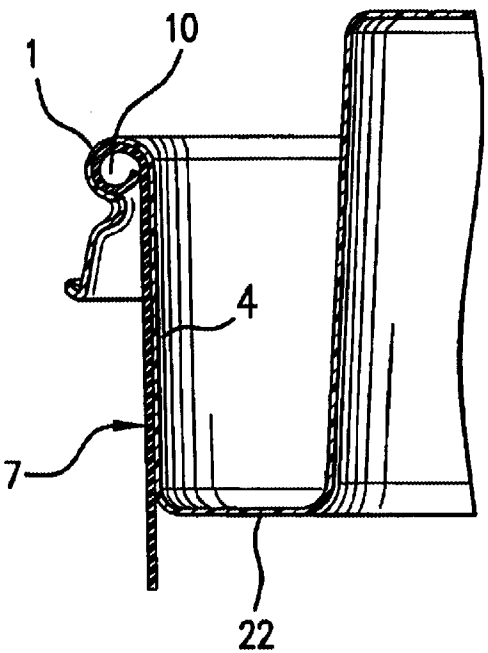
FIG. 10 is a view corresponding to FIG. 8, in a phase in which the lid is clipped-on properly.

In FIG. 10 the clip- on force R has ceased. The U-web 22 returned by elasticity into the orientation essentially perpendicular to the lid axis and presses the outer leg wall 4 against the receptacle wall 7. The apron 8 also returned by elasticity. The clamping groove 1 firmly holds the bead 10. The centring projection K and the clamping groove 1 both significantly stiffen the opening portion of the receptacle C.

Figure 11:
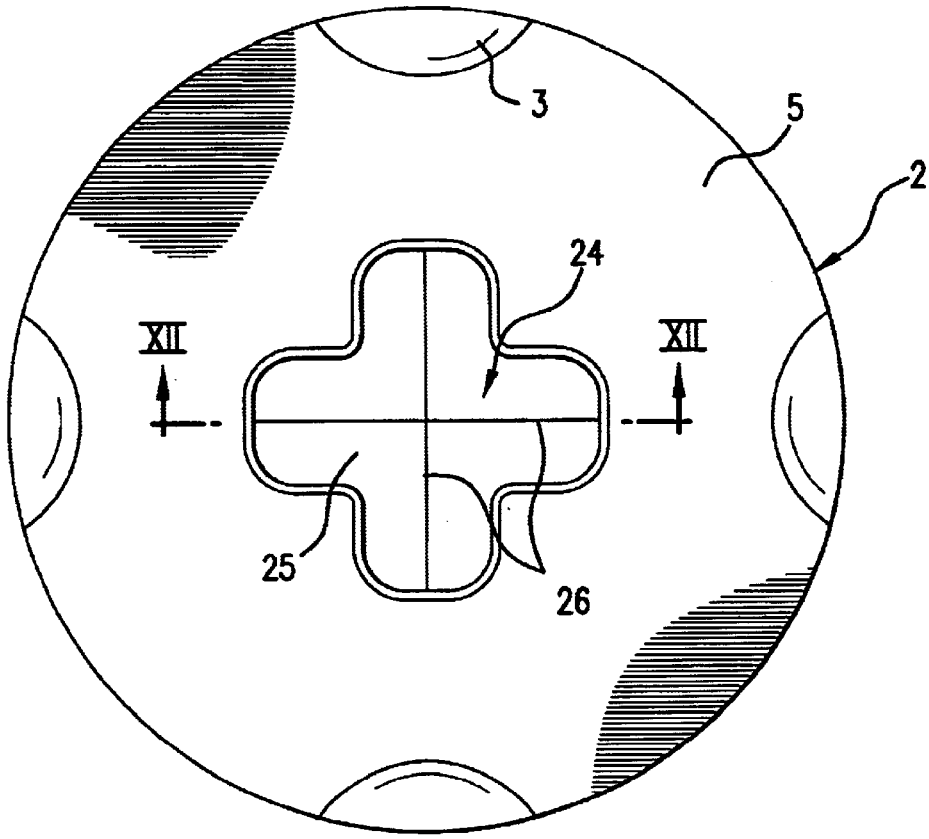
FIG. 11 is a plan view of the dome of the lid of FIG. 6.
Figure 12:
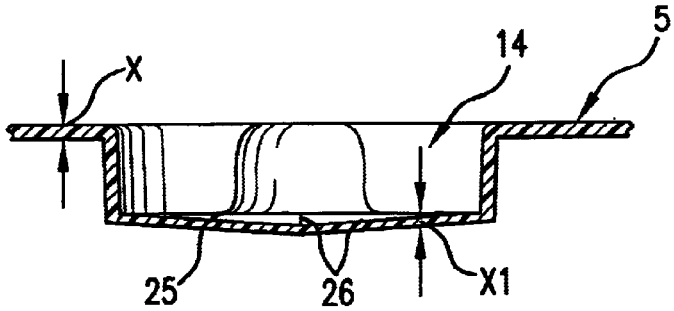
FIG. 12 is an axial section in the centre of the dome of FIG. 11 in the section plane XII—XII.

In FIG. 11 the recess 24 has a wall contour like a quatrefoil, i.e. a contour which may be characterised by two equally sized ellipses the main axes of which are offset by 90°. The score lines 26, in the region 25 extend along the main axes of both ellipses. FIG. 12 shows the difference between the wall thickness x and the wall thickness X1 in region 25 in exaggerated scale. The region 25 may be curved inwardly, as shown, or may be parallel to the dome top wall 5. The reduced wall thickness x1 is not needed for the entire region 25. It could suffice to provide only a thin walled central portion of the region 25, e.g. by compressing the material when producing the lid D. The radial width of the annular U-web 22 in FIGS. 6 to 10 may amount to about 10% of the outer diameter of the lid D, while the diameter of the dome top wall 5 may amount to about 60% of the outer diameter of the lid D.

Figure 13:
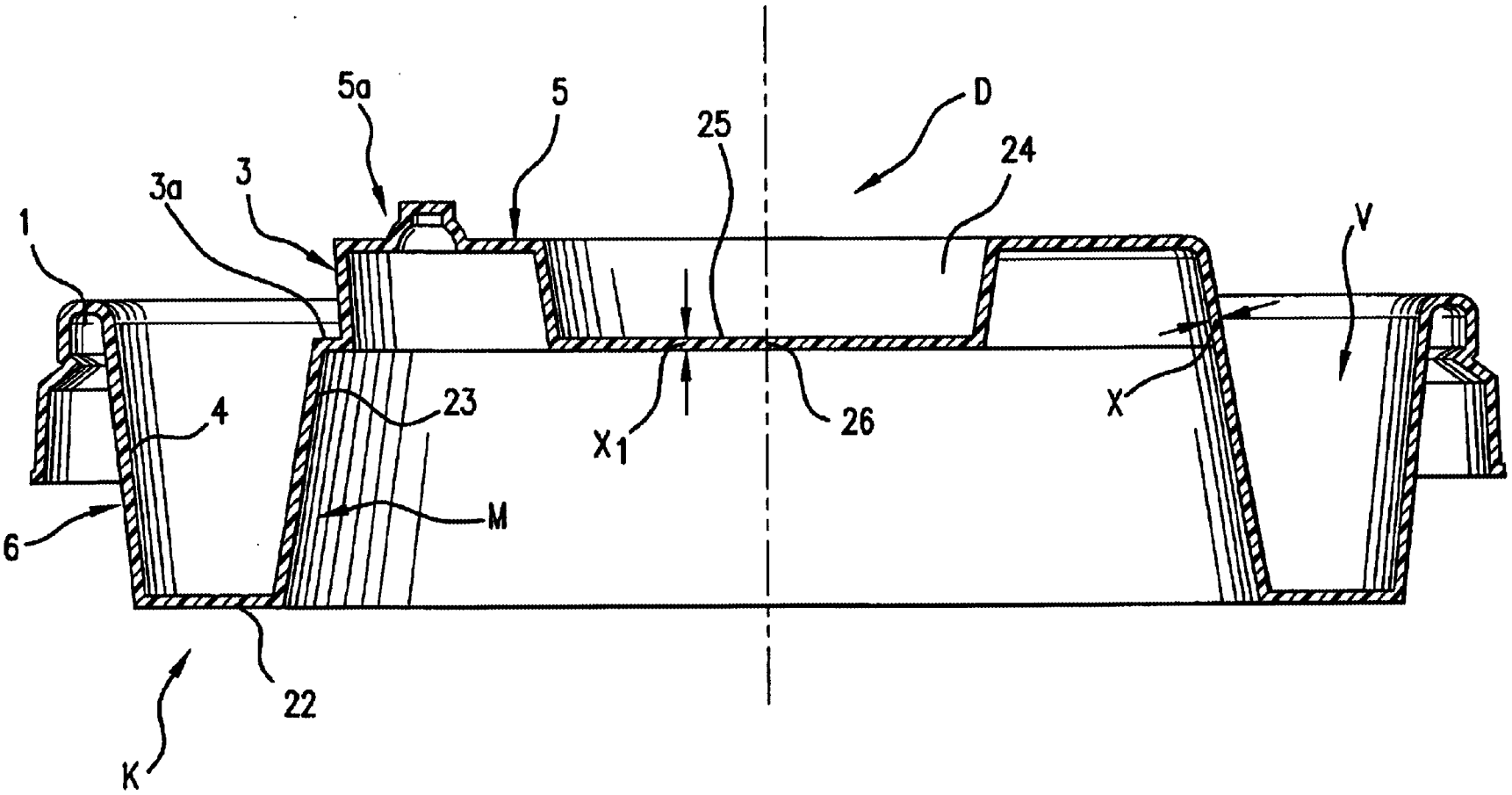
FIG. 13 is an axial sectional view of a further embodiment of a lid.
Figure 14:
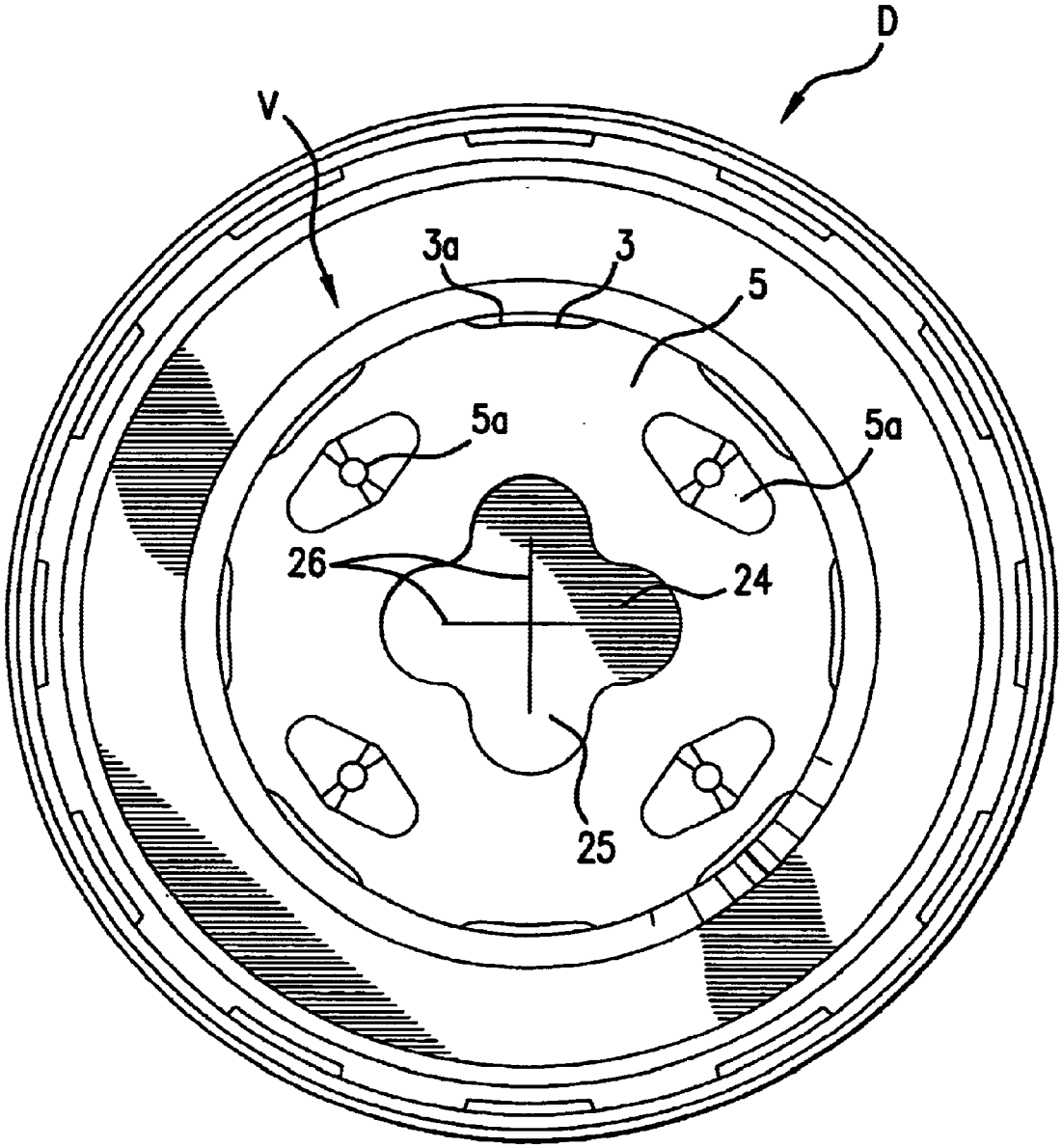
FIG. 14 is a view of the lid of FIG. 13 from above.
Figure 15:
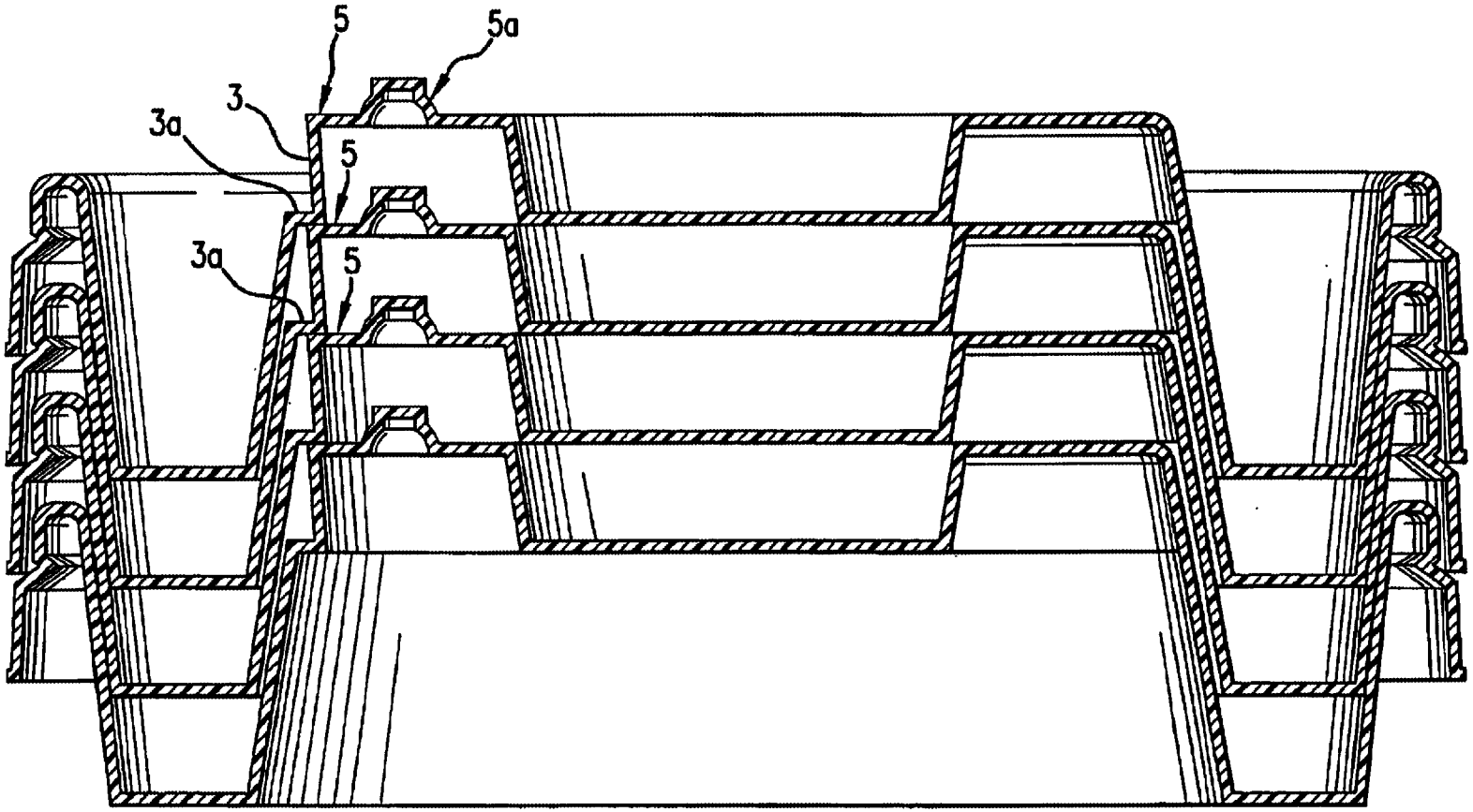
FIG. 15 is a lid stack consisting of several lids of FIGS. 13 and 14.

The embodiment of the lid D of FIGS. 13 and 14 is similar to the embodiment of FIGS. 6 to 12 but additionally is provided with regularly distributed beverage distinguishing protrusions 5*a* in the dome top wall 5. There are, e.g., four oval beverage distinguishing protrusions 5*a*, each having a marking and/or a pushable button in its top. This is standard equipment of many lids on the market. The protrusions 5*a* are located with a small radial distance from the outer edge of the dome top wall 5 and also with a small radial distance from the central recess 24. Furthermore, the depressions 3 are made undercut such that they may be gripped more easily by the finger tips when the lid D has to be removed from a stack of several lids (as shown in FIG. 15). Each depression 3 may define a lateral shoulder 3*a* which may serve as a stacking stop as shown in FIG. 15 such that shoulder 3*a* rests on the dome top wall 5 of the next lid D of the stack. The shoulder 3*a* expediently prevents that the stacked lids get jammed within each other, because the stacked lids contact each other mainly where the shoulders 3*a* rest on the dome top wall 5 and where the outer leg walls contact each other. This feature results in an orderly and dense stack from which each lid D can be removed comfortably. In the embodiment shown, eight depressions 3 are provided.

The lid D of FIGS. 13 to 15 also has the centring and guide projection K (a guide cone) and the hinge mechanism M for facilitating the clip-on action.

Figure 16:
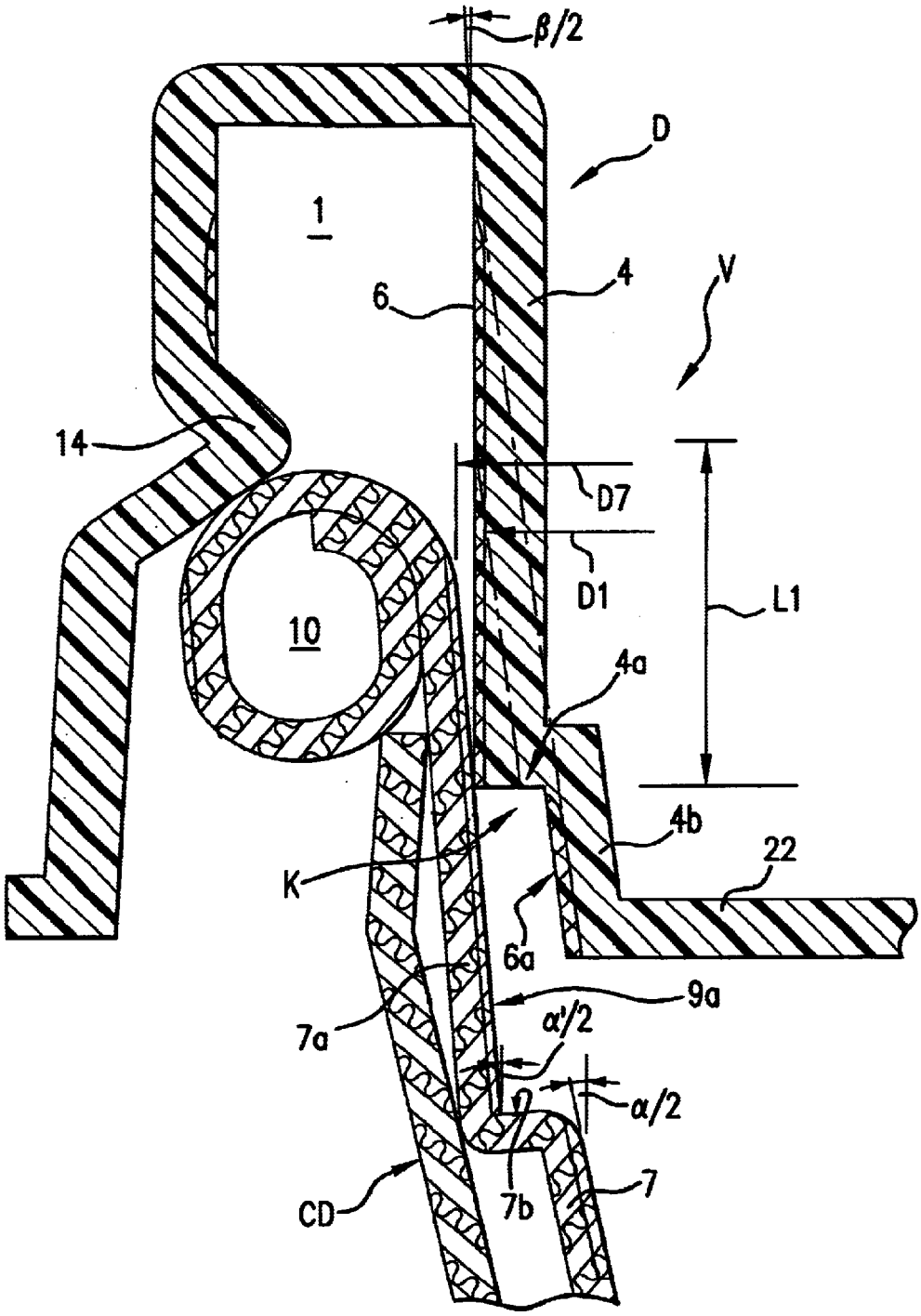
FIG. 16 is an axial sectional view of a lid and a double wall receptacle in a preparatory phase of a clip-on action of the lid.
Figure 17:
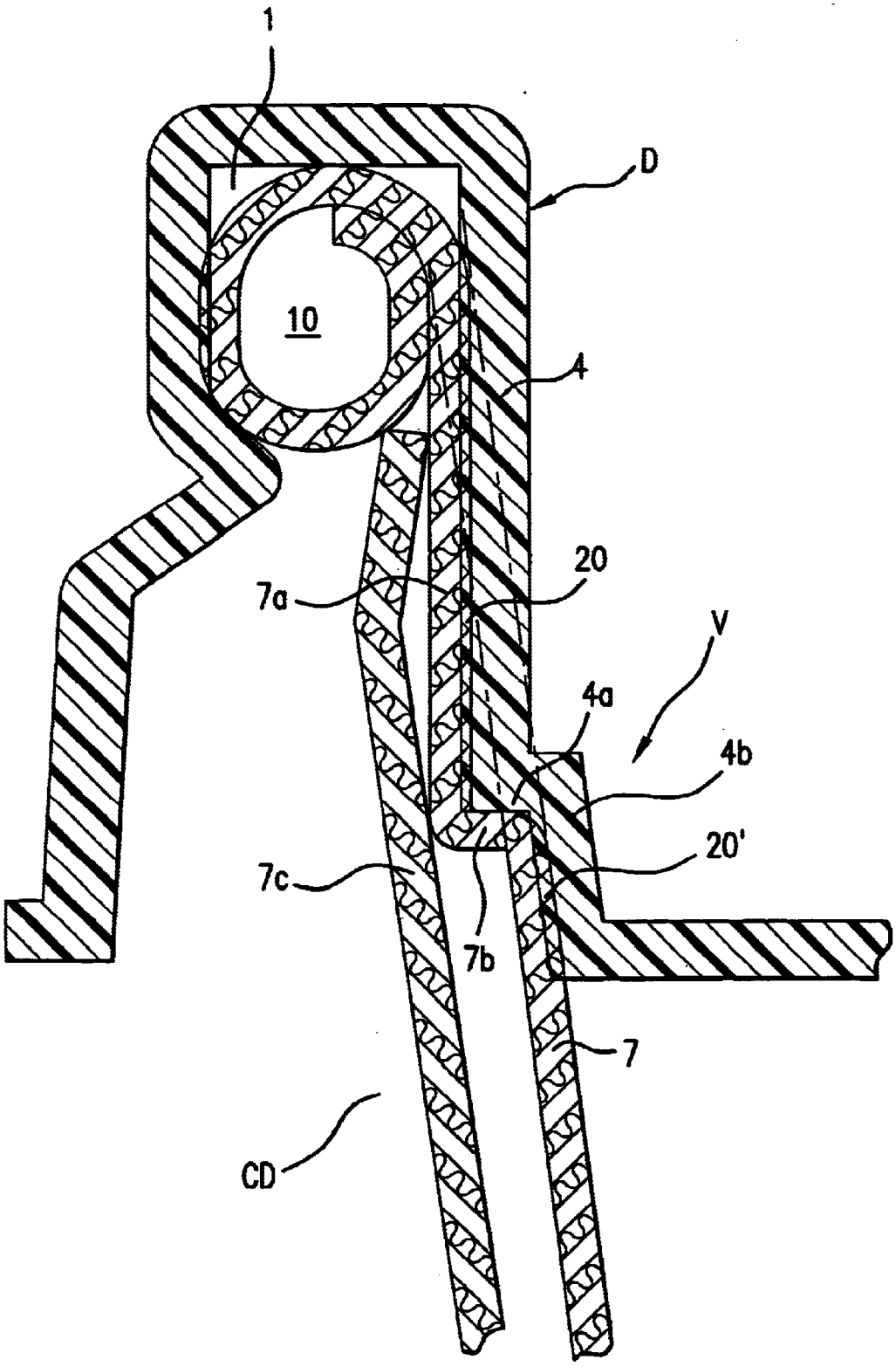
FIG. 17 is sectional view of similar of FIG. 16 with the lid fully clipped-on the double wall receptacle.

FIGS. 16 and 17 show an easy clip-on lid D for a double wall receptacle CD. The double wall receptacle CD has an inner wall 7 and an outer wall 7*c* with an air gap in-between to provide a thermal insulating effect. The bead 10 is formed at the upper end of the inner wall 7. The double wall receptacle CD first is formed with a cone angle $\alpha/2$ which continues to the bead 10. During the forming process the upper part of the inner wall 7 is widened outwards such that the opening area 9*a* results where the cone angle $\alpha'/2$ is smaller than the cone angle $\alpha/2$, or even almost zero, and such that a shoulder 7*b* is formed. The lid D for the double wall receptacle CD has the already described centring and guide projection K. In this case the projection K is formed such that the outer surface 6 either is cylindrical (as shown) or has a small cone angle $\beta/2$ between 0° (cylindrical) or a value similar but smaller than the cone angle $\alpha'/2$. The outer surface 6 or the outer leg wall 4 is continued by an inwardly stepped wall portion 4*b* such that a shoulder 4*a* is formed. The outer surface portion 6*a* of wall portion 4*b* is inclined with cone angle $\alpha/2$. The bottom of the centring and guide projection K is formed by the U-web 22 which extends substantially perpendicular to the central lid axis. The diameter D1 of the outer surface 6 corresponds essentially to the diameter D7 of the opening area 9*a* in the region of the bead 10. In the opening area 9*a* inner parts of the inner receptacle wall 7*a* and outer parts of the outer leg wall 4 and the wall portion 4*b* are indicated to be deformed or to get into intimate pressure contact when the lid D is fully clipped-on the double wall receptacle CD.

In FIG. 16 the lid D is centred on the double wall receptacle CD such that the bead 10 has approached the constriction 14 from below. Then the outer surface 6 already contacts the inner receptacle wall 7*a* in the opening area 9*a* to properly centre and guide the lid D when the clip-on pressure R is applied e.g. on the dome top wall 5 (not shown in FIG. 16).

While the clip-on pressure forces the constriction 14 over the bead 10, the outer surface 6 is guiding the lid D. When the U-web 22 is tilted downwardly, as already explained above, the outer leg wall 4 is somewhat dislocated inwardly, while the constriction 14 yields outwardly. This facilitates that the constriction 14 easily slips over the bead 10 until the position of FIG. 17 is reached. The bead 10 then is gripped from the outer side and the inner side. The contacting wall parts (20 and 20') may become squeezed. The shoulder 4*a* either is seated on the shoulder 7*b* or at least is close to shoulder 7*b*. A particular contact pressure is achieved in the region 20' resulting in an additional sealing effect in addition to the sealing effect achieved by the co-action between the clamping groove 1 and the bead 10 and between the outer leg wall 4 and the inner receptacle wall portion 7*a*. In FIG. 17, the rigid dome structure of the lid D even may force the inner receptacle wall portion 7*a* into a parallel relationship to the outer leg wall 4 resulting in a high holding force and an excellent effect and a markedly stiffened opening portion of the closed receptacle CD.

Additionally, the co-action between the shoulders 4*a*, 7*b* may result in a clip-on limiting stop preventing that the bead will be deformed too much. The abutting shoulders 4*a*, 7*b* even may maintain the bead 10 and the clamping groove 1 in a preloaded closing condition characterised by high leakage-proofness and high holding force for the lid D.

Figure 18:
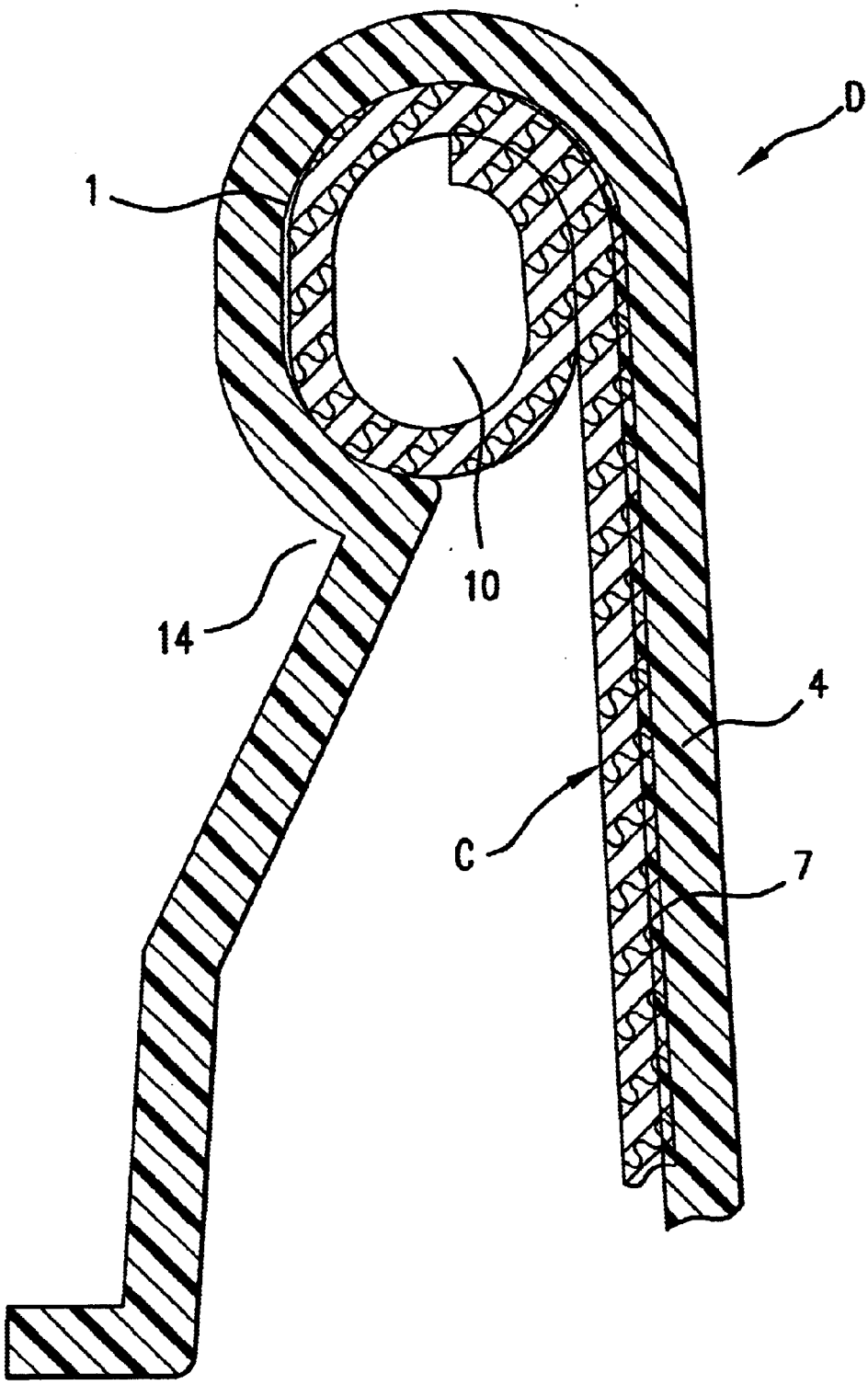
FIG. 18 is a sectional view similar to FIG. 5, of another embodiment.

FIG. 18 is a sectional view of clipped-on lid D on one-wall receptacle C, similar to FIG. 5. Bead 10 is fully curled inwards. Clamping groove 1 of the lid D is of round cross-section. The criss-cross hatched areas represent zones of strong contact, e.g. of even slightly squeezed surface portions. There is tight contact between the clamping groove 1 and the bead 10 over more than 180° of the circumference of the bead 10. The outer leg wall 4 significantly stiffens the upper opening region against radial deformation.

What is claimed is:

1. A cup-shaped receptacle of paper or cardboard, provided with a plastic material clip-on lid;

the receptacle having an opening area delimited by an upwardly and outwardly tapering conical receptacle wall and an outwardly projecting bead;

the lid having a peripheral clamping groove which is open on a lower surface of the lid for receiving therein the bead;

the clamping groove having at an outer lower end region an elastically expandable constriction, and at the inner side of a top wall a cylindrical or conical outer surface of an outer leg wall of a circuinferentially extending lid recess of U-shaped cross-section;

a U-web of the lid recess being located below the height position of the constriction;

an inner leg wall of the lid recess being part of a dome wall of a dome having a dome top wall located above the constriction and the clamping groove, respectively;

the lid recess having such a depth to markedly extend downwards beyond the height position of the constriction by a length which is equal to at least 2.5 times the height of the clamping groove, and an outer diameter at the outer surface at the elevation of the constriction largely corresponding to the inner diameter of the receptacle wall at the bead; and in the clamping groove the outer diameter of the outer surface at the transition from the top wall into the outer surface being markedly larger than the interior diameter of the receptacle wall in the opening area, such that during a clip-on operation of the lid, the lid recess outer surface functions as a lid centering and guide projection cooperating by sliding contact with the receptacle wall when the bead reaches the constriction while downwardly directed clip-on pressure mainly is applied to the dome.

2. The receptacle according to claim 1, wherein the centering and guide projection is formed with the outer diameter such that it cooperates by sliding contact with the receptacle wall already before the bead reaches the constriction from the lower side.

3. The receptacle according to claim 1, wherein the cone angles of the receptacle wall and of the conical outer surface are at least approximately equal and lie between approximately 6° and 12°.

4. The receptacle according to claim 1, wherein the dome has circumferentially regularly distributed depressions of identical size and identical depth, at the transition between the dome top wall, and the upwardly extending inner leg wall; each depression defining an undercut finger grip indent in the inner leg wall, and each depression having a lower shoulder defining a lid stacking stop.

5. The receptacle according to claim 1, wherein at least one circumferential zone having an increased coefficient of friction is provided at the outer surface of said outer leg wall and/or one inner surface of the receptacle wall.

6. The receptacle according to claim 1, wherein the average radial thickness of the bead exceeds the radial interior width of the clamping groove.

7. The receptacle according to claim 6, wherein the radial thickness of the bead exceeds the radial interior width of the clamping groove by 10% to 20%.

8. A lid of plastic material, for a conical receptacle having an exterior bead in an opening area;

the lid having a peripheral clamping groove, which has a top wall and is open on a lower surface of the lid for receiving the bead therein;

the clamping groove being continued at an outer lower end thereof by an elastically expandable constriction and at a transition from the top wall by a cylindrical or conical outer surface of an outer leg wall of a circumferentially extending lid recess of substantially U-shaped cross-section with a U-web located below the height position of the constriction;

the inner leg wall of the lid recess being part of a dome wall of a dome including a dome top surface located markedly above the height positions of the constriction and the clamping groove;

the lid recess having such a depth so as to extend downwards beyond the height position of the constriction by a length which is equal to at least 2.5 times the height of the clamping groove, and having an outer diameter at the outer surface essentially at the height position of the constriction largely corresponding to the inner diameter of the opening area at the bead such that the lid recess defines a centering and guide projection for an easy clip-on operation of the lid onto the bead of the receptacle.

9. The lid according to claim 8, wherein the constriction comprises circumferentially successive and alternating deeper and shallower depressions formed inwardly from the outer side, with, the deeper depressions being circumferentially longer than the shallower depressions.

10. The lid according to claim 8, further comprising a plurality of regularly distributed upwardly protruding beverage distinguishing protrusions in the dome top wall.

11. A lid of plastic material, for a conical doubled-walled paper or cardboard receptacle having an exterior bead at a conical and stepped opening area;

the lid having a peripheral clamping groove which has a top wall and is open on a lower surface of the lid for receiving the bead therein;

the clamping groove being continued at an outer lower end thereof by an elastically expandable constriction, and at an inner region of the top wall by a cylindrical or conical outer surface of an outer leg wall of a circuinferentially extending lid recess of substantially U-shaped cross-section with a U-web located below the height position of the constriction;

an inner leg wall of the lid recess being part of a dome wall of a dome including a dome top wall located markedly above the height positions of the constriction and the clamping groove;

the lid recess having such a depth so as to extend downwards beyond the height position of the constriction, and having an outer diameter at the outer surface at substantially the height position of the constriction largely corresponding to the inner diameter of the opening area at the bead, such that the lid recess defines a centering and guide projection for sliding co-action with the conical and stepped opening area of the double wall receptacle allowing an easy clip-on operation of the lid onto the bead, and the centering and guide projection being continued downwardly by an inward stepped portion dimensioned for a press-fit co-action with a region of receptacle wall located below the conical and stepped opening area.

12. The lid according to claim 11, wherein the outer surface of the outer leg wall is formed with a cone angle value between 0° and a value smaller than the cone angle value of the stepped receptacle opening area.

13. A cup-shaped receptacle, of paper or cardboard provided with a plastic material clip-on lid;

the receptacle having an opening area delimited by an upwardly and outwardly tapering conical receptacle wall and an outwardly projecting curled rim bead;

the lid having a peripheral clamping groove which is open on a lower surface of the lid for receiving the bead therein;

the clamping groove having at an outer lower end region an elastically expandable constriction, and at an inner side a cylindrical or conical outer surface of an outer leg wall of a circumferentially extending lid recess of U-shaped cross-section;

a U-web of the lid recess being located below the height position of the constriction;

an inner leg wall of the lid recess being part of a dome wall of a dome having a dome top wall located above the constriction and the clamping groove, respectively;

the lid recess having such a depth to markedly extend downwards beyond the height position of the constriction by a length which is equal to at least 2.5 times the height of the clamping groove, and having an outer diameter at the outer surface at the elevation of the constriction adapted to the inner diameter of the receptacle wall at the bead, such that during an easy clip-on operation of the lid, the lid recess outer surface functions as a lid centering and guide projection cooperating by sliding contact with the receptacle wall at least while the bead moves past the constriction into the clamping groove, when downwardly directed clip-on pressure mainly is applied to the dome; and the lid centering and guide projection and the clipped-on clamping groove commonly defining an annular receptacle opening area stiffening structure for preventing radial deformations of the receptacle opening area.

14. The lid according to claim 11, wherein the depth of the lid recess extends downwardly beyond the height position of the constriction by a length which is equal to at least 2.5 times the height of the clamping groove.

* * * * *